US008536934B1

(12) United States Patent
Gakhar et al.

(10) Patent No.: US 8,536,934 B1
(45) Date of Patent: Sep. 17, 2013

(54) LINEAR VOLTAGE REGULATOR GENERATING SUB-REFERENCE OUTPUT VOLTAGES

(75) Inventors: Vikram Gakhar, Bangalore (IN); Preetam Charan Anand Tadeparthy, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 13/402,898

(22) Filed: Feb. 23, 2012

(51) Int. Cl.
*G05F 1/10* (2006.01)

(52) U.S. Cl.
USPC ..... 327/540; 327/541; 327/543; 327/539

(58) Field of Classification Search
USPC ..... 327/540, 541, 538, 539, 543, 562, 327/561, 563, 77, 78, 87, 88, 89
See application file for complete search history.

(56) References Cited

U.S. PATENT DOCUMENTS

| | | | | |
|---|---|---|---|---|
| 3,824,496 | A * | 7/1974 | Hekimian | 331/132 |
| 4,051,385 | A * | 9/1977 | Greenaway et al. | 327/47 |
| 5,103,116 | A * | 4/1992 | Sivilotti et al. | 377/79 |
| 5,396,118 | A * | 3/1995 | Yaguchi | 327/516 |
| 5,929,696 | A * | 7/1999 | Lim et al. | 327/540 |
| 7,724,068 | B1 * | 5/2010 | Smith et al. | 327/513 |
| 2004/0140845 | A1 * | 7/2004 | Eberlein | 327/541 |

* cited by examiner

*Primary Examiner* — Lincoln Donovan
*Assistant Examiner* — Jung H Kim
(74) *Attorney, Agent, or Firm* — William B. Kempler; W. James Brady; Frederick J. Telecky, Jr.

(57) ABSTRACT

A linear voltage regulator includes a pair of amplifiers. A first amplifier of the pair is used in conventional fashion to generate a regulated output voltage by controlling an impedance of a pass transistor in the linear voltage regulator, the controlling being based on a difference between a reference voltage and a voltage at a first node in a voltage divider network connected between the output terminal of the voltage regulator and a ground terminal. The second amplifier of the pair compares the regulated output voltage and a voltage at a second node in the voltage divider network, and injects a proportional current into the first node. Generation of a regulated output voltage lesser than the reference voltage is thereby enabled.

11 Claims, 2 Drawing Sheets

LINEAR VOLTAGE REGULATOR GENERATING SUB-REFERENCE OUTPUT VOLTAGES

BACKGROUND

1. Technical Field

Embodiments of the present disclosure relate generally to voltage regulators, and more specifically to a linear voltage regulator design for generating sub-reference output voltages.

2. Related Art

Linear voltage regulators generally refer to voltage regulators that receive an unregulated power source as input and provide a regulated output voltage, the regulation being achieved by controlling, using feedback techniques, the ON-resistance of a pass-device (such as a pass transistor) operated in its linear or saturation region of operation, depending on the type of the pass-device (e.g., whether a bipolar junction transistor or MOS transistor). A desired value of the regulated output voltage is typically set by comparing a fraction of the output voltage with a reference voltage, and adjusting the ON-resistance of the pass-device based on the difference of the output voltage and the reference voltage.

It is often desirable to use a linear voltage regulator to provide a sub-reference output voltage, i.e., an output voltage less than the reference voltage used in the regulator. Some prior techniques for generating such sub-reference output voltages are associated with drawbacks such as larger area for implementation, greater noise associated with the regulated output voltage, etc.

SUMMARY

This Summary is provided to comply with 37 C.F.R. §1.73, requiring a summary of the invention briefly indicating the nature and substance of the invention. It is submitted with the understanding that it will not be used to interpret or limit the scope or meaning of the claims.

A linear voltage regulator comprises a voltage reference, a pass transistor, a voltage divider network, a first amplifier and a second amplifier. The voltage reference is designed to generate a reference voltage. The pass transistor is coupled between an external power source and an output terminal of the voltage regulator, an output of the voltage regulator being provided at the output terminal. The voltage divider network coupled between the output terminal and a constant reference potential. The first amplifier compares the reference voltage and a voltage at a first node in the voltage divider network and controls an impedance of the pass transistor. The second amplifier compares an output voltage of the output and a voltage at a second node in the voltage divider network, and injects a current into the first node, the current being proportional to a difference of the output voltage and the voltage at the second node.

Several embodiments of the present disclosure are described below with reference to examples for illustration. It should be understood that numerous specific details, relationships, and methods are set forth to provide a full understanding of the embodiments. One skilled in the relevant art, however, will readily recognize that the techniques can be practiced without one or more of the specific details, or with other methods, etc.

BRIEF DESCRIPTION OF THE VIEWS OF DRAWINGS

Example embodiments will be described with reference to the accompanying drawings briefly described below.

The drawing in which an element first appears is indicated by the leftmost digit(s) in the corresponding reference number.

DETAILED DESCRIPTION

Various embodiments are described below with several examples for illustration.

1. Linear Voltage Regulator

Figure 1:
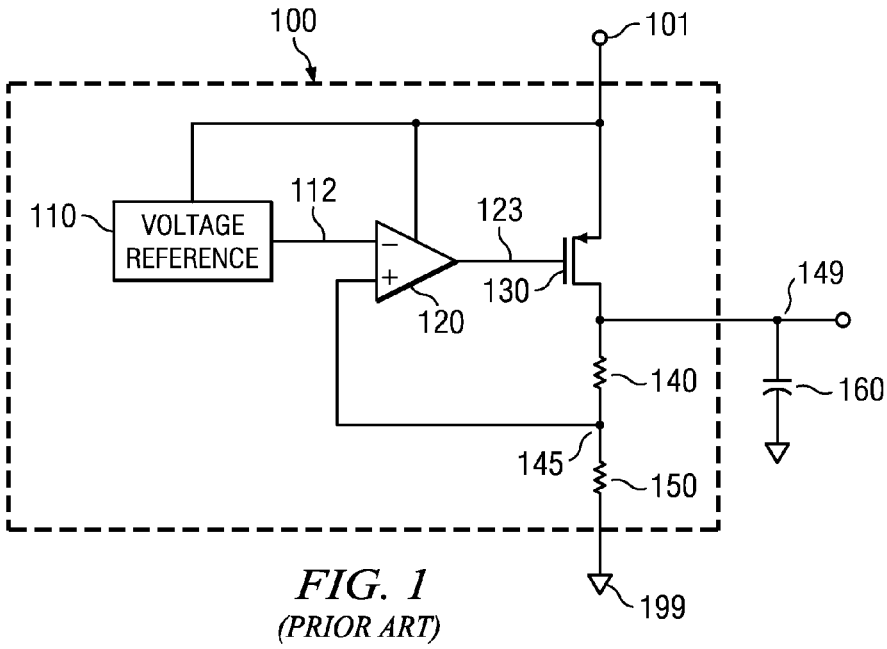
FIG. 1 (PRIOR ART)
FIG. 1 is a diagram of a conventional (prior) linear voltage regulator.

FIG. 1 is a diagram of a conventional linear voltage regulator. Low-dropout regulator (LDO) 100 is shown containing voltage reference 110, operation amplifier (OPAMP) 120, pass-transistor 130, and resistors 140 and 150. Capacitor 160 represents the output capacitance at output node 149.

Voltage reference 110, which may be implemented as a band-gap reference, generates a reference voltage on path 112, which is connected to the inverting input (−) of OPAMP 120. Resistors 140 and 150 implement a voltage divider network, and the voltage at node 145 is fed back to the non-inverting input (+) of OPAMP 120. Output 123 of OPAMP 120 controls the ON-resistance of pass transistor 130 to maintain output voltage 149 at a desired constant voltage (regulated voltage). The connection of node 145 back to OPAMP 120 implements a closed-loop feedback for regulating output voltage 149. Terminal 101 receives an unregulated voltage from a power source such as, for example, a battery (not shown).

One drawback with the conventional implementation shown in FIG. 1 is that the regulated output voltage 149 (in the steady state) cannot be lower than the value of reference voltage 112. Output voltage 149 is specified by the following equation:

$$Vo = VBG*(1+R140/R150) \qquad \text{Equation 1}$$

wherein,

VBG is value of reference voltage 112, and

R140 and R150 are respectively the resistances of resistors 140 and 150.

It may be observed from Equation 1, that the minimum value of Vo obtainable is VBG. One prior technique for obtaining an output voltage less than VBG is to scale down VBG using a resistive divider, and connecting the scaled-down voltage to the inverting (−) terminal of OPAMP 120. However, such an approach may be associated at least with power dissipation in the resistive divider (used to obtain the scaled-down VBG), higher noise in the output voltage due to the resistive divider, and increased implementation area (to accommodate the resistive divider). Further, such an approach may also be associated with start-up issues such as longer time post start-up (e.g., power-ON) for output voltage Vo to settle within an acceptable margin of its steady-state value.

2. Generating Sub-Reference Output Voltages

Figure 2:
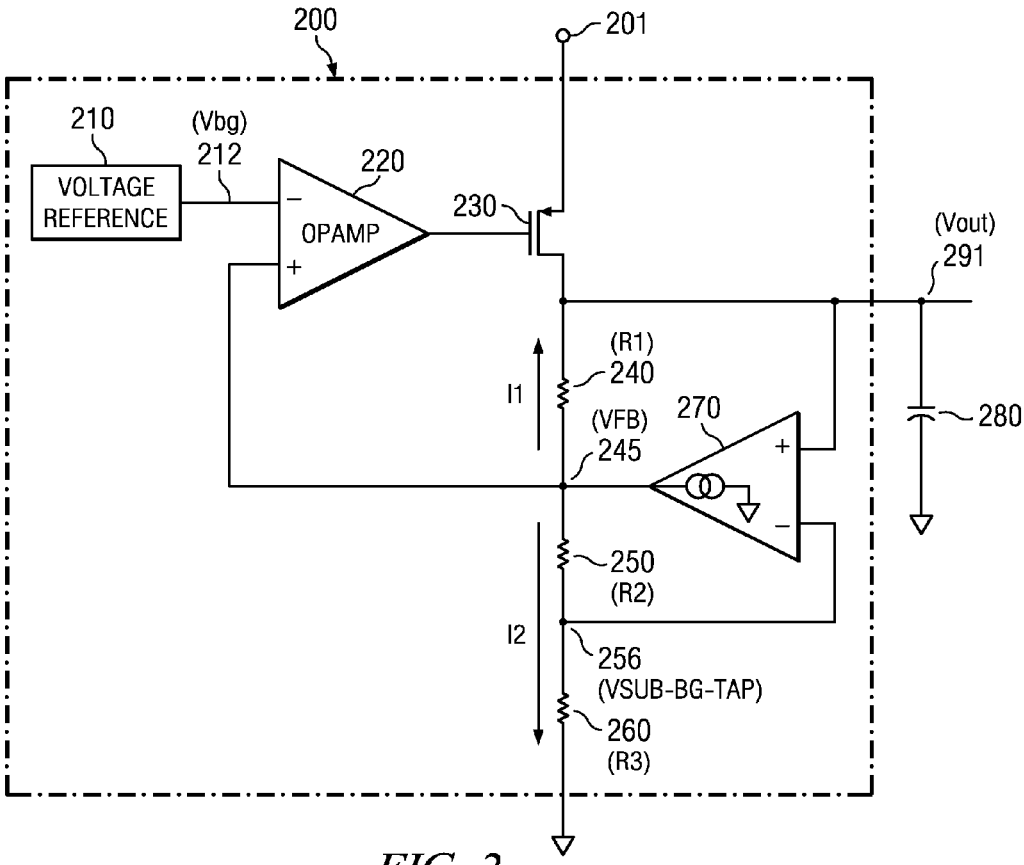
FIG. 2 is a diagram illustrating relevant details of a linear voltage regulator designed to generate sub-reference output voltages, in an embodiment.

FIG. 2 is a diagram illustrating relevant details of a linear voltage regulator designed to generate sub-reference output voltages, in an embodiment. The term 'sub-reference output voltage' means that the steady-state value of the output voltage of the linear voltage regulator is less than the value of the output voltage of the voltage reference used in the linear voltage regulator. The specific details of FIG. 2 are shown merely to illustrate the architecture of a linear voltage regulator capable of generating sub-reference output voltages. However, specific implementations of such a linear voltage regulator may additionally include other components or circuitry as well.

Low-dropout regulator (LDO) 200 is shown containing voltage reference 210, OPAMPs 220 (first amplifier) and 270 (second amplifier), pass-transistor 230, and resistors 240 (R1), 250 (R2) and 260 (R3). Output capacitor 280 is also shown connected to the output terminal 290 of LDO 200, and is provided to improve the regulation provided by LDO 200. Terminal 291 represents the output terminal of voltage regulator 200, and generates an output voltage Vout. Although not shown, one or more units (e.g., voltage reference 210, OPAMP s 220 and 270) may be powered directly by node 201. The series combination of resistors R1, R2 and R3 operates as a voltage divider network.

Voltage reference 110, OPAMP 220, pass-transistor 230, and resistors R2 and R3 correspond respectively to voltage reference 110, OPAMP 120, pass-transistor 130, and resistors 140 and 150 of FIG. 1, and their description and operation are not repeated here in the interest of conciseness. Voltage reference 210, which may be implemented as a band-gap reference, generates a voltage Vbg on path 212. Node 201 receives an unregulated power supply from a source such as, for example, a battery.

OPAMP 220 operates in closed-loop negative feedback configuration to maintain the voltage at node 245 equal to Vbg generated by voltage reference 210.

OPAMP 270 is implemented as a transconductance amplifier, and generates an output current that is proportional to the difference in the voltages at the non-inverting (+) and inverting (−) input terminals of OPAMP 270. The non-inverting (+) input of OPAMP 270 is connected to output terminal 291. The inverting (−) input of OPAMP 270 is connected to node 256. The voltage (VSUB-BG-TAP) at node 256 (second node) is always less than the voltage (VFB) at node 245 (first node), and thus also less than Vbg. With corresponding changes in the connections components of FIG. 2 (e.g., with transistor 230 being an N-type MOS (NMOS) transistor rather than a P-type MOS (PMOS) transistor as shown in FIG. 2, and with changes in the connections of OPAMP 220), LDO 200 may be designed to receive a negative voltage on node 201 and provide negative output voltages (with respect to ground). In such configurations, VSUB-BG-TAP is always greater than VFB. Thus, in general, the absolute value of VSUB-BG-TAP is always less than the absolute value of VFB. OPAMP 270 is connected in negative feedback configuration, as may be observed from FIG. 2.

OPAMP 270 operates to maintain output voltage Vout at the same magnitude as the magnitude of the voltage VSUB-BG-TAP at node 256 by controlling the currents I1 and 12 respectively flowing through the resistor R1, and the series combination of resistors R2 and R3. Since VSUB-BG-TAP is at a lower voltage than FB, regulated output voltage Vout is also lower than Vbg, and equals the voltage VSUB-BG-TAP. OPAMP 270 'pushes' current into the feedback node (245) of OPAMP 220, thereby causing current to flow in the reverse direction (i.e., from node 245 to node 291) in resistor R1. As a result, output voltage Vout is reduced below the reference voltage Vbg. By suitable selection of the ratio of R2 and R3, desired sub-reference values of Vout can be obtained.

The operation of LDO 200 to generate a sub-reference output voltage Vout may be viewed as occurring as follows:

Assume that each of OPAMPs 220 and 270 are operating normally, Vout is being regulated at the target output voltage of VBG*R3/(R2+R3). Assuming that that an upward perturbation at the output occurs, raising the Vout a little, the output current of OPAMP 270 would increase. A portion of the 'extra current' (due to the increase in the output current of OPAMP 270) flows through R1 (from node 245 to terminal 291), and the rest of the extra current flows through the series connection of R2 and R3, thereby increasing VFB. The output of OPAMP 220 therefore increases, thereby decreasing Vout, and thus nullifying the perturbation at Vout.

At steady-state, the following equalities are satisfied:

$$VFB=Vbg,$$

$$V\text{out}=VSUB\text{-}BG\text{-TAP},$$

$$VSUB\text{-}BG\text{-TAP}=VFB*R3/(R2+R3),$$

$$\text{Thus, } V\text{out}=Vbg*R3/(R2+R3),$$

wherein,

R3 and R2 respectively represent the resistances of resistors 260 and 250.

The expressions for currents I1 and I2 are provided below:

$$I1=(VFB-V\text{out})/R1=Vbg*(R2/(R1*(R2+R3)))$$

$$I2=VFB/(R2+R3)=VBG/(R2+R3)$$

Total output current generated by OPAMP 270 equals (I1+I2), and therefore equals VBG*(1+R2/R1)/(R2+R3).

Several advantages of the technique of FIG. 2 may now be apparent. LDO 200 does not require a voltage divider to scale down the reference voltage Vbg, as in the prior technique noted above. Hence, there is no area penalty that might otherwise be associated with the implementation of such a voltage divider. There are also no start-up issues as in the prior technique. Further, the output of OPAMP 220 is associated with lesser noise than it would have if a voltage divider as in the prior technique were used.

LDO 200, implemented as described above, can be incorporated in a device or system, as described next.

3. Example System

Figure 3:
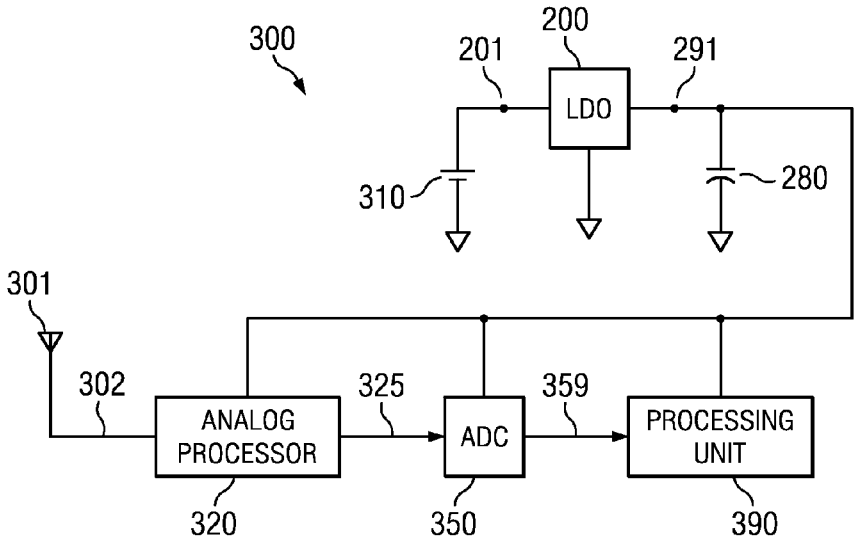
FIG. 3 is a block diagram of an example receiver system.

FIG. 3 is a block diagram of an example receiver system 300. Receiver system 300 may correspond to a mobile phone, and is shown containing antenna 301, analog processor 320, ADC 350, processing unit 390, low-dropout voltage regulator (LDO) 200, battery 310 and output capacitor 280.

Antenna 301 may receive various signals transmitted on a wireless medium. The received signals may be provided to analog processor 320 on path 302 for further processing. Analog processor 320 may perform tasks such as amplification (or attenuation as desired), filtering, frequency conversion, etc., on the received signals and provides the resulting processed signal on path 325.

ADC 350 converts the analog signal received on path 325 to corresponding digital values, which are provided on path 359 for further processing. Processing unit 390 receives the data values on path 359, and processes the data values to provide various user applications. LDO 200 provides a regulated voltage (with battery 310 being the power source) for the operation of each of analog processor 320, ADC 350, and processing unit 390. LDO 200 may be implemented as described in detail above.

While in the illustrations of FIGS. 1, 2, and 3, although terminals/nodes are shown with direct connections to (i.e., "connected to") various other terminals, it should be appreciated that additional components (as suited for the specific environment) may also be present in the path, and accordingly the connections may be viewed as being "electrically coupled" to the same connected terminals. In the instant application, power supply and ground terminals are referred to as constant reference potentials.

Further, while in FIG. 2, LDO 200 is shown as providing a positive value of output voltage, corresponding changes can be made to the connections and components of FIG. 2 to enable generation of negative voltages as well, as would be apparent to one skilled in the relevant arts. It should also be appreciated that the specific type of transistors (such as NMOS, PMOS, etc.) noted above with respect to FIG. 2 are merely by way of illustration. However, alternative embodiments using different configurations and other types of transistors, such as bipolar junction transistors (BJT) or a combination of MOS and BJT, will be apparent to one skilled in the relevant arts by reading the disclosure provided herein. For example, NMOS transistors and PMOS transistors may be swapped, while also interchanging the connections to power and ground terminals. Accordingly, in the instant application, the source (emitter) and drain (collector) terminals (through which a current path is provided when turned ON and an open path is provided when turned OFF) of transistors are termed as current terminals, and the gate (base) terminal is termed as a control terminal.

While various embodiments of the present disclosure have been described above, it should be understood that they have been presented by way of example only, and not limitation. Thus, the breadth and scope of the present disclosure should not be limited by any of the above-described embodiments, but should be defined only in accordance with the following claims and their equivalents.

What is claimed is:

1. A linear voltage regulator comprising:

a voltage reference to generate a reference voltage;

a pass transistor coupled between an external power source and an output terminal of the voltage regulator, an output of the linear voltage regulator being provided at the output terminal;

a voltage divider network coupled between the output terminal and a constant reference potential;

a first amplifier to compare the reference voltage and a voltage at a first node in the voltage divider network and to control an impedance of the pass transistor; and a second amplifier to compare an output voltage of the output and a voltage at a second node in the voltage divider network and to inject a current into the first node, wherein the current is proportional to a difference of the output voltage and the voltage at the second node, wherein the absolute value of the voltage at the first node is greater than the absolute value of the voltage at the second node, wherein the magnitude of the output voltage is less than the magnitude of the reference voltage.

2. The linear voltage regulator of claim 1, wherein the voltage divider network comprises a series connection of a first resistor, a second resistor and a third resistor, wherein the first node is a junction of the first resistor and the second resistor, wherein the second node is a junction of the second resistor and the third resistor, one terminal of the first resistor being connected to a terminal of the pass transistor, and one terminal of the third resistor being connected to the constant reference potential.

3. The linear voltage regulator of claim 1, wherein the voltage reference is a band-gap reference.

4. A linear voltage regulator comprising:

a pass-transistor, a first current terminal of the pass-transistor coupled to receive a power supply, wherein a second current terminal of the pass-transistor is an output node of the linear voltage, a regulated output voltage being provided on the output node;

a voltage reference to generate a reference voltage;

a voltage divider network comprising a first resistor, a second resistor and a third resistor, wherein a first terminal of the first resistor is coupled to the second current terminal of the pass transistor, wherein a second terminal of the first resistor is coupled to a first terminal of the second resistor at a first node, wherein a second terminal of the second resistor is coupled to a first terminal of the third resistor at a second node, and wherein a second terminal of the third resistor is coupled to a constant reference potential;

a first operational amplifier (OPAMP), wherein an inverting input terminal of the first OPAMP is coupled to receive the reference voltage, wherein a non-inverting terminal of the first OPAMP is coupled to the first node, and wherein an output terminal of the first OPAMP is coupled to a control terminal of the pass-transistor; and a second operational amplifier (OPAMP), wherein an inverting input terminal of the second OPAMP is coupled to the second node, wherein a non-inverting terminal of the second OPAMP is coupled to the output terminal, and wherein an output terminal of the first OPAMP is coupled to a control terminal of the pass-transistor.

5. The linear voltage regulator of claim 4, wherein the second OPAMP is a transconductance amplifier, wherein a current output at the output terminal of the second OPAMP is proportional to a difference in the voltages at the inverting input terminal of the second OPAMP and the non-inverting input terminal of the second OPAMP.

6. The linear voltage regulator of claim 4 wherein the absolute value of the voltage at the first node is greater than the absolute value of the voltage at the second node, whereby the magnitude of the regulated output voltage is less than the magnitude of the reference voltage.

7. The linear voltage regulator of claim 6, wherein the voltage reference is a band-gap reference.

8. A device comprising:

an antenna to receive a signal on a wireless medium;

an analog processor to process the signal and to generate a processed signal;

an analog to digital converter (ADC) to receive the processed signal as input and to generate a plurality of digital values representing the processed signal;

a processing unit to process the plurality of digital values; and a voltage regulator to receive power from a battery, and to provide a regulated output voltage for the operation of each of the analog processor, ADC, and the processing unit, wherein, the voltage regulator comprises:

a voltage reference to generate a reference voltage;

a pass transistor, wherein a first current terminal of the pass transistor is coupled to a terminal of the battery, a second current terminal of the pass-transistor is an output terminal of the voltage regulator, an output of the voltage regulator being provided at the output terminal;

a voltage divider network coupled between the output terminal and a constant reference potential;

a first amplifier to compare the reference voltage and a voltage at a first node in the voltage divider network and to control an impedance of the pass transistor; and a second amplifier to compare an output voltage of the output and a voltage at a second node in the voltage divider network and to inject a current into the first node, wherein the current is proportional to a difference of the output voltage and the voltage at the second node.

9. The device of claim 8, wherein the absolute value of the voltage at the first node is greater than the absolute value of the voltage at the second node, wherein the magnitude of the output voltage is less than the magnitude of the reference voltage.

10. The device of claim 9, wherein the voltage divider network comprises a series connection of a first resistor, a second resistor and a third resistor, wherein the first node is a junction of the first resistor and the second resistor, wherein the second node is a junction of the second resistor and the resistor, one terminal of the first resistor being connected to a terminal of the third pass transistor, and one terminal of the third resistor being connected to the constant reference potential.

11. The device of claim 10, wherein the voltage reference is a band-gap reference.

* * * * *